US007471036B2

(12) United States Patent
Jeong et al.

(10) Patent No.: US 7,471,036 B2
(45) Date of Patent: Dec. 30, 2008

(54) SHADOW MASK FOR A CATHODE RAY TUBE WITH DEFINED BEAM PASSAGES HOLES

(75) Inventors: Soon-Dong Jeong, Suwon-si (KR); Do-Hun Pyun, Suwon-si (KR); Chang-Mog Jo, Suwon-si (KR); Jae-Kwang Ryu, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 115 days.

(21) Appl. No.: 11/389,033

(22) Filed: Mar. 27, 2006

(65) Prior Publication Data

US 2006/0226755 A1 Oct. 12, 2006

(30) Foreign Application Priority Data

Apr. 8, 2005 (KR) ..... 10-2005-0029455

(51) Int. Cl.
*H01J 29/80* (2006.01)
*H01J 29/07* (2006.01)

(52) U.S. Cl. ..... 313/402; 313/403; 313/477 R; 313/407

(58) Field of Classification Search ..... 313/402–403, 313/404–406, 477
See application file for complete search history.

(56) References Cited

U.S. PATENT DOCUMENTS 5,928,047 A * 7/1999 Ishibashi et al. ..... 445/30
6,133,682 A 10/2000 Murai et al.
6,175,185 B1 * 1/2001 Aibara ..... 313/402
6,313,574 B1 * 11/2001 Banno et al. ..... 313/402
2002/0014821 A1 * 2/2002 Kobayashi et al. ..... 313/402
2002/0101148 A1 * 8/2002 Lim ..... 313/403
2002/0135286 A1 * 9/2002 Ha et al. ..... 313/402
2003/0102794 A1 * 6/2003 Lim ..... 313/402
2004/0189179 A1 * 9/2004 Karita et al. ..... 313/407

FOREIGN PATENT DOCUMENTS

KR 10-1998-057636 9/1998

OTHER PUBLICATIONS

Lee et al., Korean Patent Publication 10-1998-057636 (Machine Translation).*

* cited by examiner

*Primary Examiner*—Sikha Roy
*Assistant Examiner*—Tracie Y Green
(74) *Attorney, Agent, or Firm*—Robert E. Bushnell, Esq.

(57) ABSTRACT

A shadow mask for a cathode ray tube has an effective screen portion having a plurality of beam passage holes arranged in a predetermined pattern, and an inactive portion with no beam passage holes. The length of a beam passage hole at a column adjacent to a division between the effective screen portion and the inactive portion (hereinafter "the beam passage hole length") in the long-sided direction is set to be smaller than the length of a beam passage hole placed at the short-sided center of the column. The beam passage hole length "a" at columns which are even-numbered from the long-sided center of the effective screen portion is set to satisfy the condition of $1>a/A\geqq0.45$, compared to the length A of the beam passage hole placed at the short-sided center of relevant columns. The beam passage hole length "b" at columns which are odd-numbered is set to satisfy the condition of $1>b/B\geqq0.35$, compared to the length B of the beam passage hole placed at the short-sided center of relevant columns.

12 Claims, 8 Drawing Sheets

SHADOW MASK FOR A CATHODE RAY TUBE WITH DEFINED BEAM PASSAGES HOLES

CLAIM OF PRIORITY

This application makes reference to, incorporates the same herein, and claims all benefits accruing under 35 U.S.C. §119 from an application for SHADOW MASK FOR CATHODE RAY TUBE, earlier filed in the Korean Intellectual Property Office on the $8^{th}$ of April 2005 and there, duly assigned Ser. No. 10-2005-0029455.

BACKGROUND OF THE INVENTION

1. Technical Field

The present invention relates to a shadow mask for a cathode ray tube and, in particular, to a shadow mask for a cathode ray tube which enhances display image quality by defining the length of beam passage holes formed at the periphery of the effective screen area within a suitable range, thereby reducing the non-light emitting region while making the light emitting uniform.

2. Related Art

Generally, a cathode ray tube includes an electron gun for emitting electron beams, a deflection yoke for deflecting the electron beams, a shadow mask for color-selecting the electron beams, and a panel with an inner phosphor film. The electron beams emitted from the electron gun are deflected by the deflection magnetic fields from the deflection yoke, and the deflected electron beams pass through the color-selecting shadow mask and then collide against green, blue and red phosphors of the phosphor film, thereby emitting light to display the desired images.

The shadow mask color-selectively passes the electron beams, and correctly lands them on the relevant phosphors of the phosphor film. For this purpose, beam passage holes with a predetermined pattern are formed in the shadow mask to pass the electron beams.

The shadow mask is commonly demarcated into an effective screen portion having the beam passage holes and an inactive portion having no holes. The beam passage holes are arranged in a zigzag manner so that the bridges at the neighboring columns are not placed on the same line.

Accordingly, when beam passage holes with a full length are formed at any one column from the division between the effective screen portion and the inactive portion, the length of the beam passage holes placed at the column adjacent to the former column close to the division is set to ½ of the full length.

Although the phosphor film formed on the panel is wider in area than the effective screen portion, the electron beams passed through the beam passage holes at the division do not reach the edge of the phosphor film so that the non-light emitting area of the phosphor film is increased, and the display image quality is deteriorated. That is, the non-light emitting area where the phosphor film does not emit light exists at the edge portion of the phosphor film and has a large width.

SUMMARY OF THE INVENTION

It is an object of the present invention to provide a shadow mask for a cathode ray tube which defines the length of the beam passage holes formed close to the division between the effective screen portion and the inactive portion within a predetermined range, and which reduces the non-light emitting area of the phosphor film while making the light emission uniform, thereby enhancing the display image quality.

This and other objects is achieved by a shadow mask for a cathode ray tube with the following features.

According to one aspect of the present invention, a shadow mask for a cathode ray tube has an effective screen portion having a plurality of beam passage holes arranged in a predetermined pattern, and an inactive portion having no beam passage holes. The length of the beam passage hole at a column adjacent to the division between the effective screen portion and the inactive portion in the long-sided direction is set to be smaller than the length of the beam passage hole placed at the short-sided center of the column.

The length a of the beam passage hole adjacent to the division between the effective screen portion and the inactive portion at the columns which are even-numbered from the long-sided center of the effective screen portion is set so as to satisfy the condition of $1>a/A\geqq 0.45$, compared to the length A of the beam passage hole placed at the short-sided center of the relevant columns.

The length b of the beam passage hole adjacent to the division between the effective screen portion and the inactive portion at the columns which are odd-numbered from the long-sided center of the effective screen portion is set so as to satisfy the condition of $1>b/B\geqq 0.35$, compared to the length B of the beam passage hole placed at the short-sided center of the relevant columns.

When the length of the first beam passage hole placed at a column closest to the division between the effective screen portion and the inactive portion is smaller than the length of the beam passage hole placed at the short-sided center of the column, the overall length of the beam passage holes at the column is reduced, and the second and third beam passage holes placed close to the division are controlled in length by the reduced length such that the overall length of the beam passage holes is maintained constant.

The width c of the bridge between the beam passage holes placed at a column close to the division between the effective screen portion and the inactive portion is set to satisfy the condition of $1>c/C\geqq 0.6$, compared to the width C of the bridge between the beam passage holes placed at the short-sided center of the column.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

The present invention will be described more fully hereinafter with reference to the accompanying drawings, in which the preferred embodiments of the invention are shown.

Figure 1:
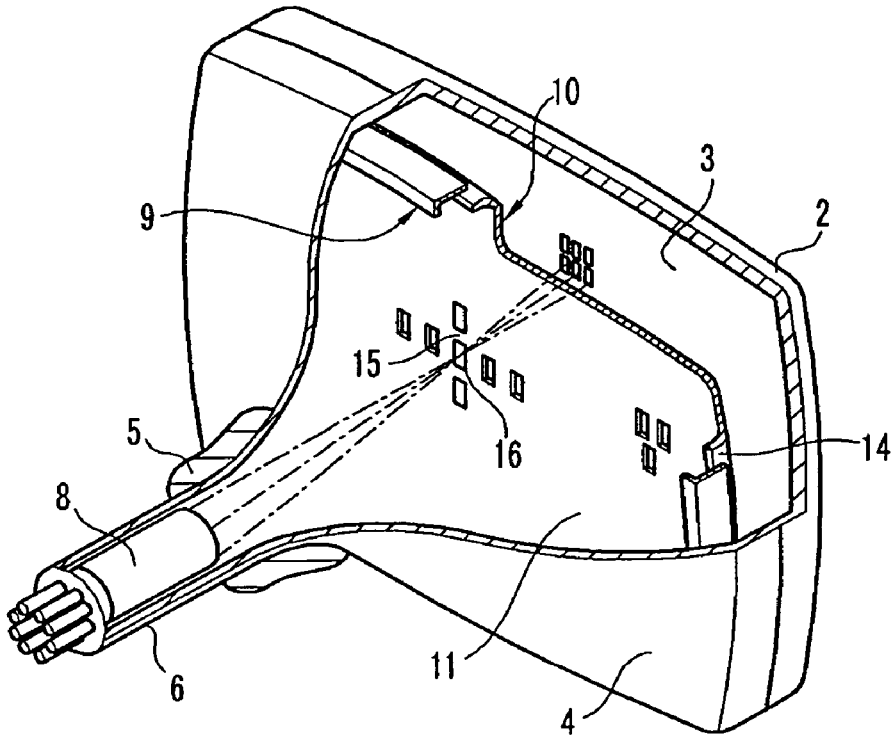
FIG. 1 is a partial sectional oblique view of a cathode ray tube with a shadow mask according to an embodiment of the present invention.
Figure 2:
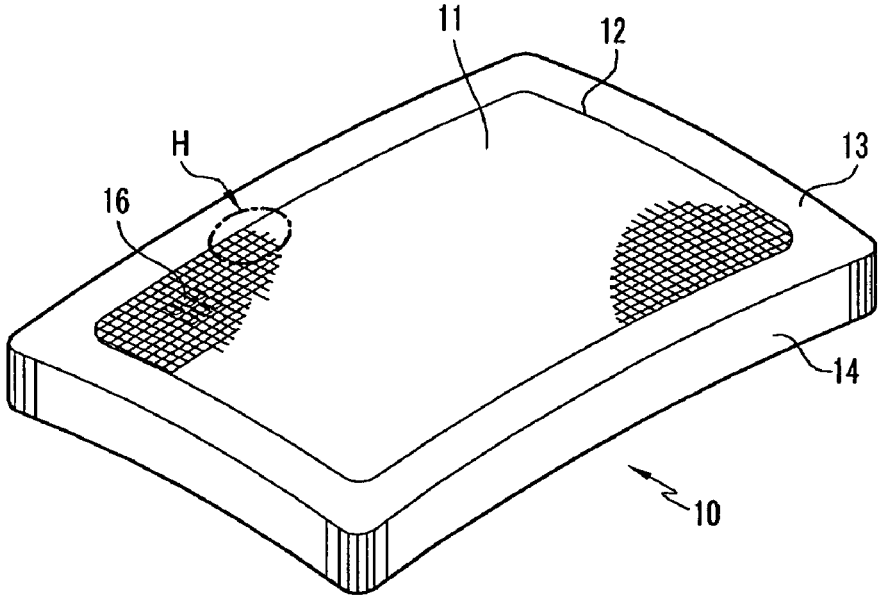
FIG. 2 is an oblique view of a shadow mask for a cathode ray tube according to an embodiment of the present invention.

FIG. 1 is a partial sectional oblique view of a cathode ray tube with a shadow mask according to an embodiment of the present invention, and FIG. 2 is an oblique view of a shadow mask for a cathode ray tube according to an embodiment of the present invention.

Referring to FIGS. 1 and 2, a cathode ray tube according to an embodiment of the present invention has a vacuum vessel with a panel 2, a funnel 4 and a neck 6. The cathode ray tube further has a shadow mask 10, an electron gun 8 and a deflection yoke 5.

Phosphors of red R, green G and blue B colors are formed on the inner surface of the panel 2 with a dot or stripe pattern while interposing a black matrix BM.

The electron gun 8 is mounted within the neck 6 to emit electron beams, and the deflection yoke 5 is mounted on the outer circumference of the funnel 4 to deflect the electron beams emitted from the electron gun 8.

The panel 2, the funnel 4 and the neck 6 are incorporated into a body so as to form a vacuum vessel.

A shadow mask 10 is mounted within the panel 2, and is supported by a frame 9. The shadow mask 10 is spaced apart from the phosphor film 3 by a predetermined distance.

As shown in FIGS. 1 and 2, a plurality of beam passage holes 16 are formed in the shadow mask 10 with a predetermined pattern so as to pass the electron beams.

The shadow mask 10 is demarcated into an effective screen portion 11 to be used in practically representing the target images and having beam passage holes 16, and an inactive portion 13 having no beam passage holes and which is not used in representing the display images.

A bridge 15 is formed between the neighboring beam passage holes so as to sustain the strength and shape thereof.

The effective screen portion 11 is completely surrounded by the inactive portion 13.

A skirt portion 14 is formed in the shadow mask 10 so as to fix the shadow mask 10 to the frame 9. The skirt portion 14 is bent from the edge of the inactive portion 13 toward the frame 9.

With the above-structured cathode ray tube, the electron beams emitted from the electron gun 8 are deflected by the deflection magnetic fields of the deflection yoke 9, and the deflected electron beams pass through the beam passage holes 16 of the shadow mask 10, and collide against the green, blue and red phosphors of the phosphor film 3, thereby exciting them and displaying the desired images.

The beam passage holes 16 of the shadow mask 10 are roughly shaped as rectangles so that the long side thereof extends parallel to the vertical side of the effective screen portion 11.

The beam passage holes 16 are formed by etching the shadow mask 10 from both surfaces thereof through photo etching. That is, a photoresist film is coated onto both surfaces of a precursor of the shadow mask 10, and a pair of disks are tightly adhered to those photoresist films with a pattern corresponding to the beam passage holes 16. The photoresist films are exposed to light, and are developed to thereby form photoresist patterns corresponding to the patterns of the disks. The precursor of the shadow mask 10 with the photoresist patterns is etched from the both surfaces thereof, thereby forming the beam passage holes 16.

Figure 3:
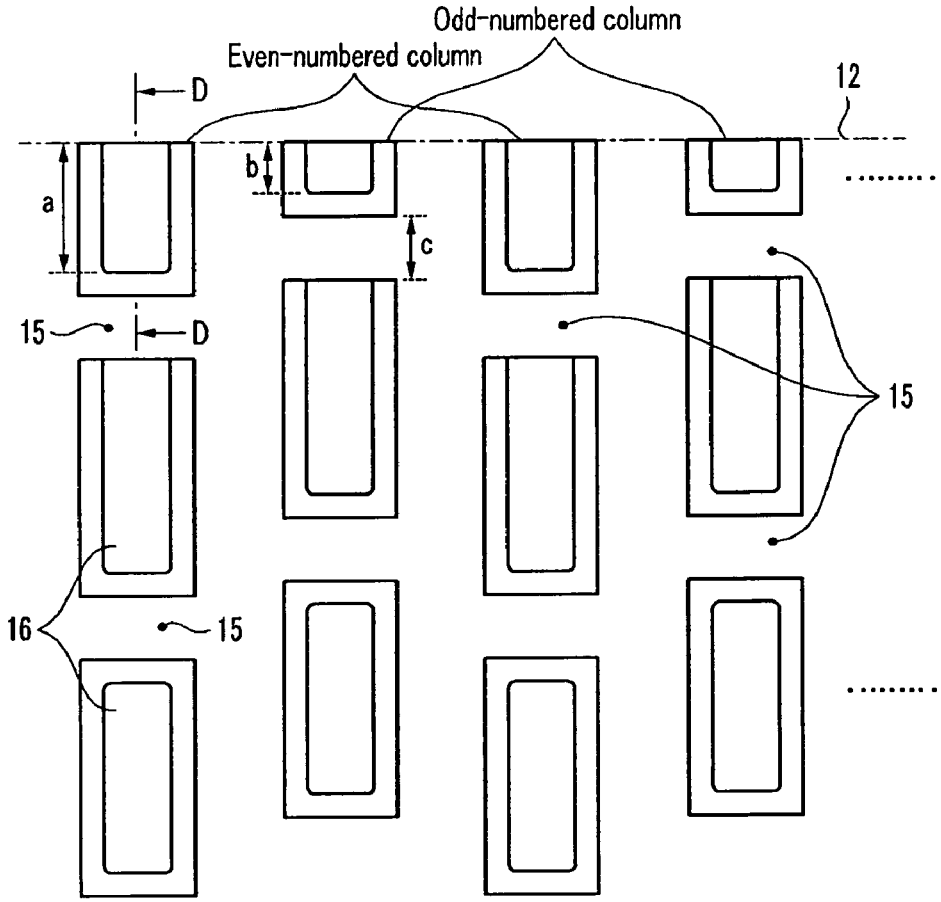
FIG. 3 is an amplified view of the portion H of FIG. 2 illustrating the division between the effective screen portion and the inactive portion of the shadow mask.
Figure 4:
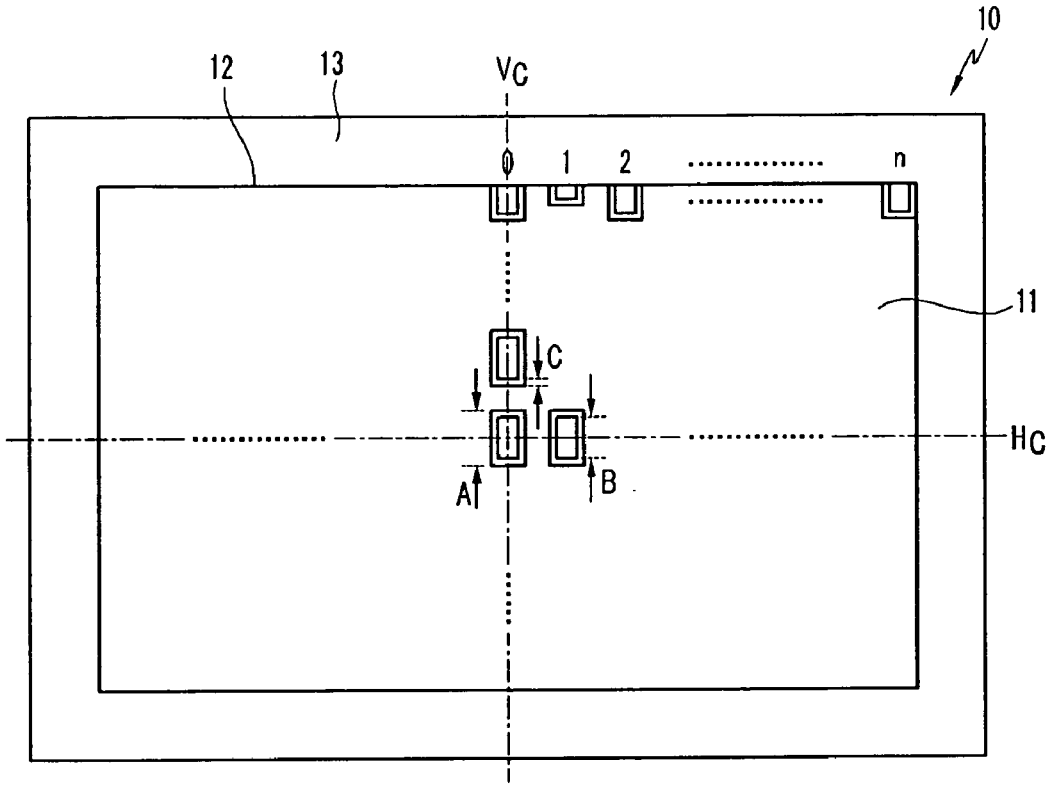
FIG. 4 is a plan view of a shadow mask for a cathode ray tube according to an embodiment of the present invention.
Figure 5:
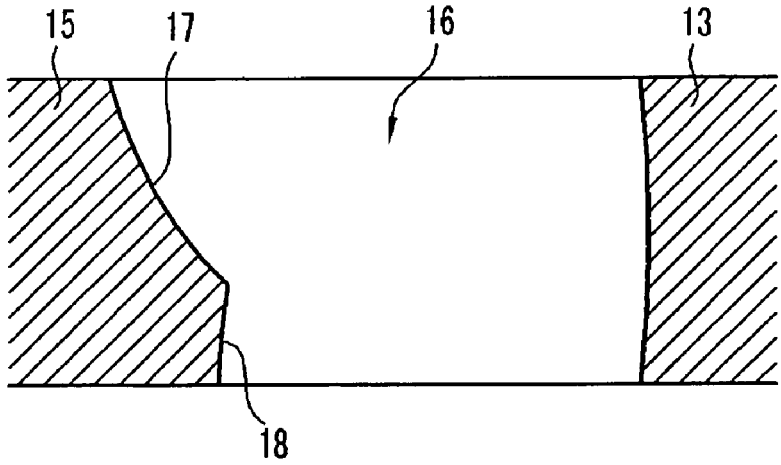
FIG. 5 is a cross-section view of the shadow mask taken along the line D-D of FIG. 3.

FIG. 3 is an amplified view of the portion H of FIG. 2 illustrating the division between the effective screen portion and the inactive portion of the shadow mask, FIG. 4 is a plan view of a shadow mask for a cathode ray tube according to an embodiment of the present invention, and FIG. 5 is a cross-section view of the shadow mask taken along the line D-D of FIG. 3.

Referring to FIGS. 3 and 5, the beam passage holes formed through double-face etching are differentiated in size at both entrances thereof. The entrance 18 of the beam passage hole with a small size is directed toward the electron gun 8, while the entrance 17 of the beam passage hole with a large size is directed toward the panel 2.

Referring to FIGS. 3 and 4, with the shadow mask 10 for a cathode ray tube according to an embodiment of the present invention, the beam passage hole 16 at any one column adjacent to the division 12 between the effective screen portion 11 and the inactive portion 13 in the long-sided direction has a length smaller than the length of the beam passage hole 16 placed at the short sided center of that column.

The length of the beam passage hole 16 is determined based on the short-sized entrance 18 thereof, that is, based on the pure hole size.

The length a of the beam passage hole 16 at the columns which are even-numbered (0, 2, 4, 6, . . . ) from the long-sided center, adjacent to the division between the effective screen portion 11 and the inactive portion 13, is set so as to satisfy the condition of $1>a/A\geqq0.45$, compared to the length A of the beam passage hole 16 placed at the short-sided center of those columns.

When the value of a/A is 1 or more, the peripheral beam passage hole 16 becomes larger in size than the central beam passage hole 16, and the electron beams passed therethrough are liable to collide against the incorrect phosphors, thereby deteriorating the display image quality. By contrast, when the value of a/A is smaller than 0.45, the amount of electron beams passed through the peripheral beam passage hole 16 is too small to properly excite the relevant phosphors.

The length b of the beam passage hole 16 at the columns which are odd-numbered (1, 3, 5, . . . ) from the long-sided center, adjacent to the division between the effective screen portion 11 and the inactive portion 13, is preferably set so as to satisfy the condition of $1>b/B\geqq0.35$, compared to the length B of the beam passage hole 16 placed at the short-sided center of those columns.

When the value of b/B is 1 or more, the peripheral beam passage hole 16 becomes larger in size than the central beam passage hole 16, and hence the electron beams passed therethrough are liable to collide against the incorrect phosphors, thereby deteriorating the display image quality. By contrast, when the value of b/B is less than 0.35, the amount of electron beams passed through the peripheral beam passage hole is too small to properly excite the relevant phosphors.

In order to effectively control the amount and direction of electron beams passed through the beam passage holes 16 when they are deflected, it is preferable to form the beam passage holes 16 such that the size thereof is gradually reduced from the center toward the long-sided and the short-sided edges.

The lengths a and b of the beam passage holes 16 adjacent to the division 12 between the effective screen portion 11 and the inactive portion 13 are established so as to be smaller than the lengths A and B of the beam passage holes 16 placed at the short-sided center of the relevant columns. When the overall length of the beam passage holes at the relevant column is reduced, the second and the third beam passage holes 16 placed close to the division 12 are increased in length by the reduced length such that the overall length of the beam passage holes is maintained constant.

That is, compared to the case of formation of the beam passage holes in a conventional way, when the length of the first beam passage hole 16 placed closest to the division 12 is reduced, the second and third beam passage holes 16 placed close to the division 12 are increased in length by the reduced length such that the overall length of the beam passage holes is maintained constant.

If it is difficult to increase the lengths of the second and the third beam passage holes 16, the number of the beam passage holes 16 is increased by one, and the lengths of the second and third beam passage holes 16 are established to have a value smaller than the normal value such that the overall length of the beam passage holes is maintained constant.

The width c of the bridge 15 between the beam passage holes 16 placed at a column close to the division 12 between the effective screen portion 11 and the inactive portion 13 is established so as to satisfy the condition of $1>c/C\geqq 0.6$, compared to the width C of the bridge 15 between the beam passage holes 16 placed at the short-sided center of the column.

The width c of the bridge 15 is preferably established so as to cope with the controlled lengths of the first beam passage hole 16 adjacent to the division, and the second and the third beam passage holes 16.

In particular, it is preferable in preventing the white stripe phenomenon that the width c of the bridge 15 at the odd-numbered columns be smaller than the width of the bridge at the even-numbered columns.

As shown in FIGS. 3 and 5, with a shadow mask 10 for a cathode ray tube according to an embodiment of the present invention, the corners of one to four beam passage holes 16 adjacent to the division 12 between the effective screen portion 11 and the inactive portion 13 are roughly right-angled without having any inclined portions.

That is, the corners of the beam passage holes 16 adjacent to the division 12 are formed based on the corners of the small entrance 18.

When the corners of the beam passage holes 16 adjacent to the division 12 are right-angled, with the exposure of light for forming a phosphor film while mounting the shadow mask 10 within the panel 2, the exposure light is not diffused remotely so that the light exposure is carried out more precisely, and the phosphors are located more correctly.

Figure 6:
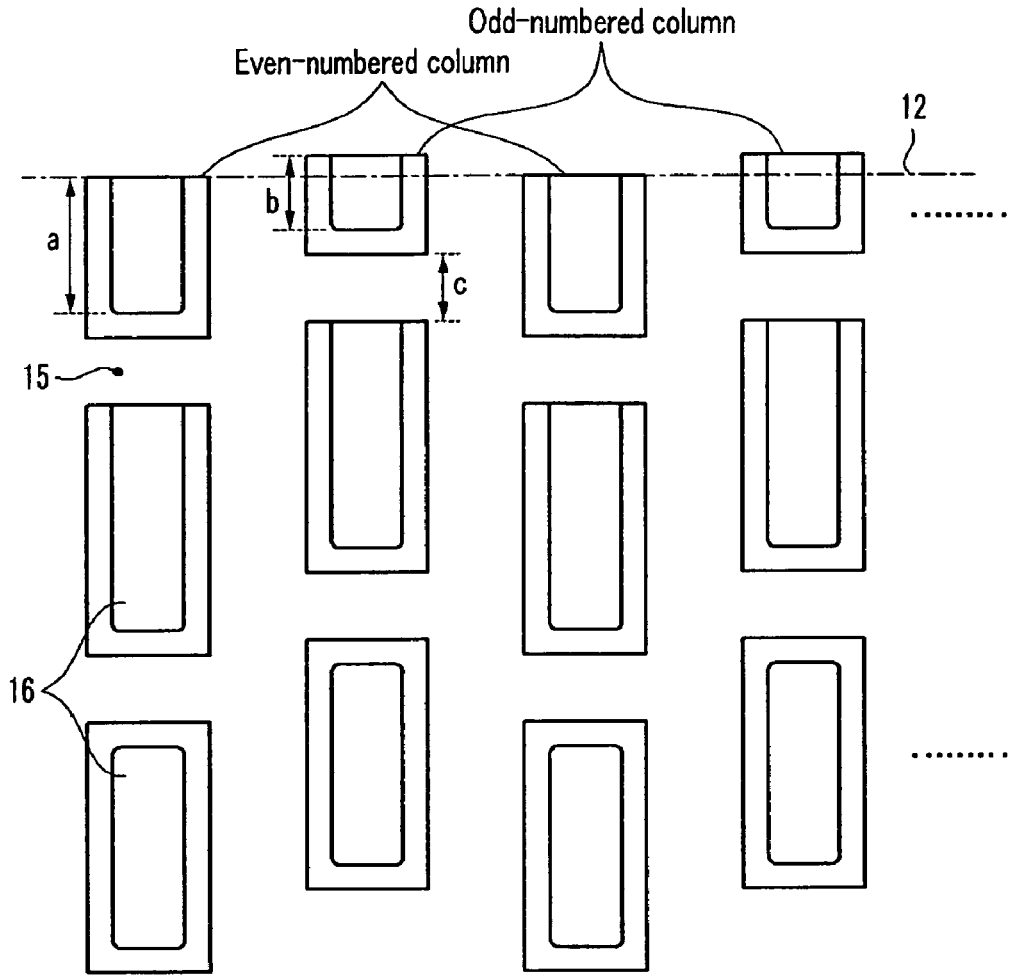
FIG. 6 is an amplified view of a shadow mask for a cathode ray tube according to another embodiment of the present invention, illustrating the division between the effective screen portion and the inactive portion corresponding to the illustration shown in FIG. 3.
Figure 7:
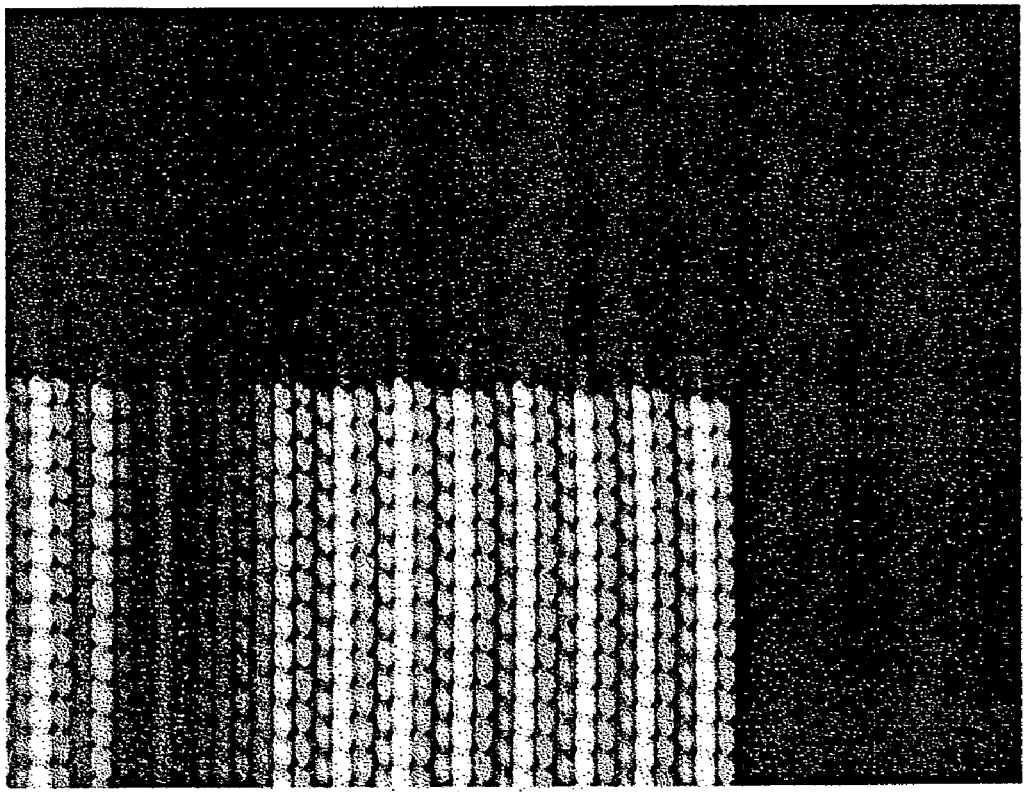
FIG. 7 is a photograph of the light emitting state of a phosphor film of a cathode ray tube with a shadow mask according to an embodiment of the present invention.
Figure 8:
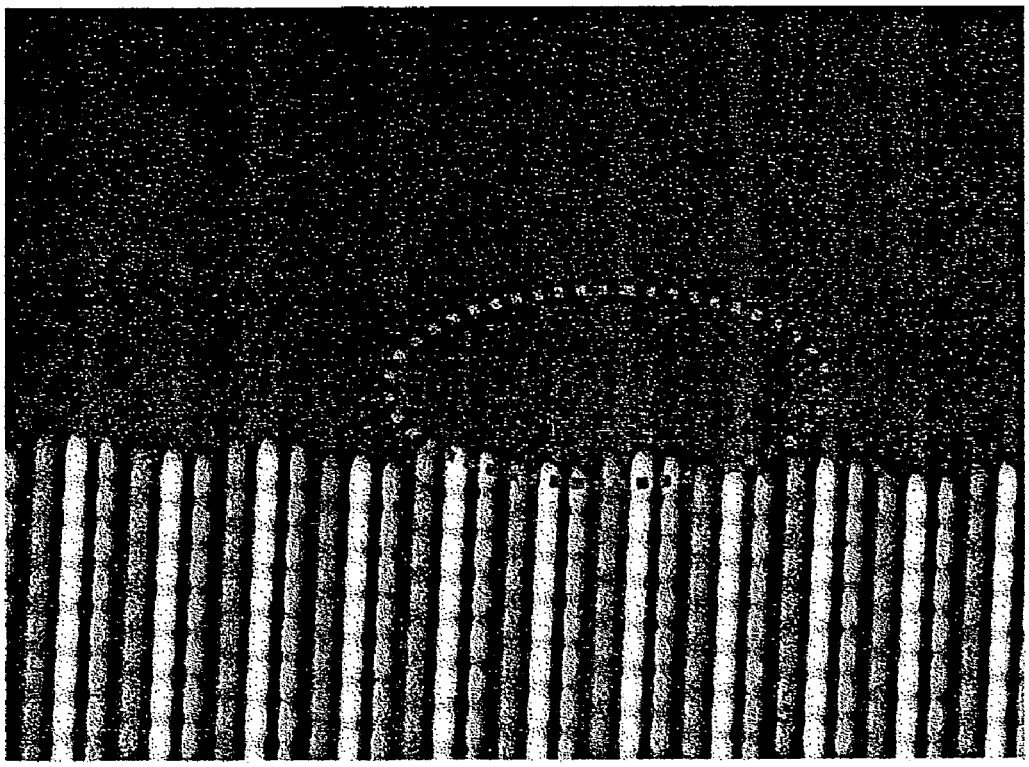
FIG. 8 is a photograph of the light emitting state of a phosphor film of a cathode ray tube having a conventional shadow mask.

FIG. 6 is an amplified view of a shadow mask for a cathode ray tube according to another embodiment of the present invention, illustrating the division between the effective screen portion and the inactive portion corresponding to the illustration shown in FIG. 3, FIG. 7 is a photograph of the light emitting state of a phosphor film of a cathode ray tube having a shadow mask according to an embodiment of the present invention, and FIG. 8 is a photograph of the light emitting state of a phosphor film of a cathode ray tube having a conventional shadow mask.

FIG. 7 is a photograph of the light emitting state of the phosphor film where a shadow mask for a cathode ray tube according to the embodiment of the present invention is used and wherein the division 12 is amplified. When compared to the photograph of FIG. 8, wherein a conventional shadow mask is used, it can be seen that the non-light emitting region of the division 12 is improved.

With the usage of the conventional shadow mask, the width of the non-light emitting region was measured to be about 2.0-2.5 mm. In contrast, with the usage of the shadow mask for a cathode ray tube according to the present invention, the width of the non-light emitting region was measured to be about 1.0-1.2 mm. Thus is, it can be seen that the width of the non-light emitting region is significantly reduced with the present invention.

As shown in FIG. 6, with a shadow mask 10 for a cathode ray tube according to another embodiment of the present invention, the edge of the beam passage hole 16 adjacent to the division 12 between the effective screen portion 11 and the inactive portion 13 goes over the division 12 toward the inactive portion 13.

In particular, the edge of the beam passage hole 16 at the columns which are odd-numbered from the center neighboring to the division 12 is biased toward the inactive portion 13.

In order to make the device slim, it is more effective to apply the shadow mask to the cathode ray tube where the maximum deflection angle is 110° or more (compared to the conventional cathode ray tube wherein the maximum deflection angle is in the range of 102-106°).

With the shadow mask for a cathode ray tube according to the present invention, as the length of the beam passage hole placed close to the division between the effective screen portion and the inactive portion is set to be smaller than the length of the beam passage hole placed at the center, the non-light emitting region is reduced, and the shape of the divisional area becomes uniform, thereby enhancing the display image quality.

Furthermore, with the shadow mask for a cathode ray tube according to the present invention, as the corners of the beam passage hole placed close to the division are established to be right-angled, the exposure light with the formation of the phosphor film is not diffused so that the phosphor film can be formed with a precise pattern.

In addition, with the shadow mask for a cathode ray tube according to the present invention, it is possible to make the width of the bridge at the odd-numbered columns smaller than the width of the bridge at the even-numbered columns, and therefore a white stripe phenomenon is prevented.

Although preferred embodiments of the present invention have been described in detail hereinabove, it should be clearly understood that many variations and/or modifications of the basic inventive concept herein taught may appear to those skilled in the art but will still fall within the spirit and scope of the present invention, as defined in the appended claims.

What is claimed is:

1. A shadow mask for a cathode ray tube, comprising:

an effective screen portion having a plurality of beam passage holes arranged in a predetermined pattern; and an inactive portion having no beam passage holes;

wherein a length of the beam passage hole at a column adjacent to a division between the effective screen portion and the inactive portion in a long-sided direction is set to be smaller than a length of the beam passage hole placed at a short-sided center of the column; and wherein a length a of the beam passage hole adjacent to the division between the effective screen portion and the inactive portion at columns which are even-numbered from a long-sided center of the effective screen portion is set to satisfy the condition $1>a/A\geqq 0.45$, where A is a length of the beam passage hole placed at the short-sided center of relevant columns.

2. A shadow mask for a cathode ray tube comprising:

an effective screen portion having a plurality of beam passage holes arranged in a predetermined pattern; and an inactive portion having no beam passage holes;

wherein a length of the beam passage hole at a column adjacent to a division between the effective screen portion and the inactive portion in a long-sided direction is set to be smaller than a length of the beam passage hole placed at a short-sided center of the column; and wherein a length b of the beam passage hole adjacent to the division between the effective screen portion and the inactive portion at columns which are odd-numbered from a long-sided center of the effective screen portion is set to satisfy the condition $1>b/B\geqq0.35$ where B is a length of the beam passage hole placed at the short-sided center of relevant columns.

3. The shadow mask for a cathode ray tube of claim 2, wherein when a length of the first beam passage hole placed at a column closest to the division between the effective screen portion and the inactive portion is smaller than a length of the beam passage hole placed at the short-sided center of the column, an overall length of the beam passage holes at the column is reduced, and a second beam passage hole and a third beam passage hole placed close to the division are controlled in length by the reduced length such that the overall length of the beam passage holes is maintained constant.

4. The shadow mask for a cathode ray tube of claim 2, wherein a width c of a bridge between the beam passage holes placed at a column close to the division between the effective screen portion and the inactive portion is established to satisfy the condition $1>c/C\geqq0.6$, compared to a width C of the bridge between the beam passage holes placed at the short-sided center of the column.

5. The shadow mask for a cathode ray tube of claim 4, wherein columns are odd numbered from the long-sided center where the width c of the bridge between the beam passage holes placed close to the division between the effective screen portion and the inactive portion is established to satisfy the condition $1>c/C\geqq0.6$, compared to the width C of the bridge between the beam passage holes placed at the short-sided center of a relevant column.

6. The shadow mask for a cathode ray tube of claim 2, wherein an edge of the beam passage hole adjacent to the division between the effective screen portion and the inactive portion goes over the division toward the inactive portion.

7. The shadow mask for a cathode ray tube of claim 2, wherein corners of one to four of beam passage holes placed close to the division between the effective screen portion and the inactive portion are right-angled without having any inclined portions.

8. The shadow mask for a cathode ray tube of claim 1, wherein when a length of the first beam passage hole placed at a column closest to the division between the effective screen portion and the inactive portion is smaller than a length of the beam passage hole placed at the short-sided center of the column, an overall length of the beam passage holes at the column is reduced, and a second beam passage hole and a third beam passage hole placed close to the division are controlled in length by the reduced length such that the overall length of the beam passage holes is maintained constant.

9. The shadow mask for a cathode ray tube of claim 1, wherein a width c of a bridge between the beam passage holes placed at a column close to the division between the effective screen portion and the inactive portion is established to satisfy the condition $1>c/C\geqq0.6$, where C is a width of the bridge between the beam passage holes placed at the short-sided center of the column.

10. The shadow mask for a cathode ray tube of claim 9, wherein columns are odd numbered from the long-sided center where the width c of the bridge between the beam passage holes placed close to the division between the effective screen portion and the inactive portion is established to satisfy the condition $1>c/C\geqq0.6$, compared to the width C of the bridge between the beam passage holes placed at the short-sided center of a relevant column.

11. The shadow mask for a cathode ray tube of claim 1, wherein an edge of the beam passage hole adjacent to the division between the effective screen portion and the inactive portion goes over the division toward the inactive portion.

12. The shadow mask for a cathode ray tube of claim 1, wherein corners of one to four of beam passage holes placed close to the division between the effective screen portion and the inactive portion are right-angled without having any inclined portions.

* * * * *